US011759038B1

(12) United States Patent
Huebner

(10) Patent No.: US 11,759,038 B1
(45) Date of Patent: Sep. 19, 2023

(54) COLLAPSIBLE CUP HOLDER APPARATUS

(71) Applicant: Mark Huebner, Omaha, NE (US)

(72) Inventor: Mark Huebner, Omaha, NE (US)

(73) Assignee: Patark Industries, LLC, Omaha, NE (US)

( * ) Notice: Subject to any disclaimer, the term of this patent is extended or adjusted under 35 U.S.C. 154(b) by 212 days.

(21) Appl. No.: 16/425,543

(22) Filed: May 29, 2019

(51) Int. Cl.

| | |
|---|---|
| ***A45F 5/00*** | (2006.01) |
| ***A45F 3/00*** | (2006.01) |
| ***A47G 23/02*** | (2006.01) |
| ***A45C 13/42*** | (2006.01) |
| *A45C 13/00* | (2006.01) |
| *B65D 5/36* | (2006.01) |

(52) U.S. Cl.
CPC ..... *A47G 23/02* (2013.01); *A45F 5/00* (2013.01); *A45C 13/001* (2013.01); *A45F 2200/0583* (2013.01); *B65D 5/3628* (2013.01)

(58) Field of Classification Search
CPC ..... A47G 23/02; A47G 23/0216; A47G 23/0291; A47G 23/0208; A47G 2023/0283; A47G 2023/0291; A45F 5/00; A45F 2200/0583; A45F 2200/05; A45F 5/021; A45F 3/16; A45C 7/0077; A45C 11/20; A45C 13/001; A45C 13/28; A45C 2013/306; B60R 11/00; B65D 5/3628; B65D 81/3876; Y10S 220/903
USPC ..... 248/311.2; 211/113, 74; 206/459.5; 220/737, 23.83, 751, 738; 297/188.06; 229/117.01
See application file for complete search history.

(56) References Cited

U.S. PATENT DOCUMENTS

| | | | | | |
|---|---|---|---|---|---|
| 308,418 | A | * | 11/1884 | Lockwood | A45C 3/00 383/26 |
| 2,707,035 | A | * | 4/1955 | Lashley | A45C 5/00 294/142 |
| 3,747,776 | A | * | 7/1973 | Gross | A41D 27/18 206/527 |
| 4,090,542 | A | * | 5/1978 | Hacker, Jr. | A45C 7/0077 190/107 |
| D265,864 | S | * | 8/1982 | Kracke | D3/243 |
| 4,540,611 | A | * | 9/1985 | Henderson | B65D 23/08 428/36.5 |
| 4,717,262 | A | * | 1/1988 | Roen | B65D 31/08 383/104 |
| 4,932,576 | A | * | 6/1990 | Ashley | A45F 5/02 224/904 |
| 4,974,709 | A | * | 12/1990 | Furlow | A45C 3/00 150/111 |
| D334,286 | S | * | 3/1993 | Keene | 224/904 |
| 5,244,175 | A | * | 9/1993 | Frankel | A47G 23/0225 248/230.8 |
| 5,354,131 | A | * | 10/1994 | Mogil | A45C 7/0086 150/109 |
| 5,445,315 | A | * | 8/1995 | Shelby | B65D 5/3628 229/117.06 |

(Continued)

*Primary Examiner* — Gideon R Weinerth
(74) *Attorney, Agent, or Firm* — Suiter Swantz pc llo

(57) ABSTRACT

A collapsible cup apparatus may include, but is not limited to, one or more collapsible panels. The apparatus may also include one or more plates. The one or more plates may be coupled to the one or more collapsible panels. The apparatus may further include one or more attaching mechanisms. The one or more attaching mechanisms may be coupled to at least one of the one or more collapsible panels or the one or more plates.

7 Claims, 12 Drawing Sheets

(56) References Cited

U.S. PATENT DOCUMENTS

D380,607 S * 7/1997 Leben ..... D3/243
D382,106 S * 8/1997 Hillestad ..... D3/215
5,671,832 A * 9/1997 London ..... A45C 5/14 190/102
5,772,066 A * 6/1998 Reynolds ..... A45C 7/0063 220/23.83
5,791,488 A * 8/1998 Lee ..... A45C 3/00 190/125
5,829,559 A * 11/1998 Nordstrom ..... A45C 5/14 190/102
6,138,882 A * 10/2000 Buettner ..... A45C 15/00 248/104
6,390,431 B1 5/2002 Ott
D515,497 S * 2/2006 Watson ..... D12/416
7,510,157 B2 * 3/2009 Oliver ..... A47G 23/0225 224/400
7,958,920 B1 * 6/2011 Olsson ..... A45C 3/001 150/112
8,066,148 B2 11/2011 Garahan
8,235,190 B2 8/2012 Porte et al.
8,307,966 B2 11/2012 Cummins
8,752,726 B2 * 6/2014 Molz ..... G06Q 30/0241 220/739
D739,766 S * 9/2015 Glass ..... D9/705
9,241,554 B1 1/2016 Tong
9,295,320 B1 * 3/2016 McManus ..... A45F 5/021
D767,945 S * 10/2016 Yu ..... D7/620
9,516,941 B1 * 12/2016 Moulton ..... A47G 23/0225
D778,597 S * 2/2017 Lynch ..... D3/229
9,578,939 B2 2/2017 Nebeling
9,809,440 B2 * 11/2017 Kellerman ..... B67D 1/16
D830,689 S * 10/2018 Duran ..... A47G 23/0225 D3/229
10,226,116 B1 * 3/2019 Porres ..... A45F 3/02
10,369,915 B1 * 8/2019 Haynes ..... B64D 11/0638
D866,952 S * 11/2019 Duran ..... D3/202
D873,001 S * 1/2020 Alvarez ..... D3/274
11,313,605 B2 * 4/2022 Kieling ..... B65D 25/2882
2002/0125090 A1 * 9/2002 Mercado ..... A45C 7/0036 190/107
2002/0148868 A1 * 10/2002 Dion-Bildstein ..... B60N 3/103 224/401
2004/0200943 A1 * 10/2004 Rokov ..... A47G 23/0216 248/311.2
2004/0252919 A1 * 12/2004 Welch ..... B65D 81/3886 383/110
2006/0022006 A1 * 2/2006 Cruise ..... A45C 13/28 224/572
2006/0037825 A1 * 2/2006 Dayton ..... A47G 23/0225 190/110
2006/0219745 A1 * 10/2006 Riley ..... A47G 23/0225 224/400
2006/0243768 A1 * 11/2006 Dowell ..... B60R 11/00 224/400
2007/0089953 A1 * 4/2007 Kohn ..... A45F 3/16 190/102
2007/0181617 A1 * 8/2007 Ramsey ..... B65D 81/3879 224/148.3
2008/0116342 A1 * 5/2008 Oliver ..... A47G 23/0225 248/311.2
2009/0159386 A1 * 6/2009 Kuhn ..... A45C 13/30 190/102
2009/0159605 A1 * 6/2009 Rosenberg ..... B65D 5/3678 220/737
2010/0051633 A1 * 3/2010 Porte ..... A45C 13/28 220/737
2012/0067683 A1 * 3/2012 Cummins ..... A47C 7/70 190/115
2012/0187138 A1 * 7/2012 Vasquez ..... A45C 3/001 220/739
2012/0228293 A1 * 9/2012 Combs ..... A45F 5/02 220/200
2013/0098954 A1 * 4/2013 Inglis ..... A45F 5/00 224/148.4
2013/0126540 A1 * 5/2013 Vesterby ..... A45C 13/28 220/737
2013/0126686 A1 * 5/2013 Ballou ..... A47G 23/0225 248/205.2
2014/0110202 A1 * 4/2014 Vesterby ..... A45C 13/30 190/103
2015/0021346 A1 * 1/2015 Cappuccio ..... A45F 5/00 220/735
2016/0022032 A1 * 1/2016 Simon ..... A45C 13/28 108/42
2016/0081505 A1 * 3/2016 Berg ..... A45F 5/00 224/401
2016/0113365 A1 * 4/2016 Lank ..... A45C 3/00 383/40
2016/0227949 A1 * 8/2016 Klugh ..... A45C 13/28
2017/0325559 A1 * 11/2017 Johnson ..... A47G 23/0216
2018/0271310 A1 * 9/2018 Klugh ..... A45C 13/28
2019/0071211 A1 * 3/2019 Lacayo ..... A45C 3/02
2019/0075917 A1 * 3/2019 Preston ..... A41D 27/20
2019/0352075 A1 * 11/2019 Waltermire ..... B65D 81/3897
2021/0100385 A1 * 4/2021 Delaney ..... A47G 23/0225
2021/0282520 A1 * 9/2021 Weng ..... A45C 13/262
2022/0175166 A1 * 6/2022 Avellanet ..... A45F 5/00
2022/0265032 A1 * 8/2022 Datcher ..... A61L 2/26
2022/0346514 A1 * 11/2022 Karl ..... A45C 5/03

* cited by examiner

COLLAPSIBLE CUP HOLDER APPARATUS

TECHNICAL FIELD

The present invention generally relates to luggage tags, and more particularly, to a collapsible luggage tag apparatus for holding a beverage.

BACKGROUND

Often it is desirable to place your beverage in a cup holder while traveling. Further, it is often desirable to place a luggage tag on a suitcase, bag, or the like when traveling such that personal identification information is contained on one's suitcase, bag, or the like while traveling. Current traveling cup holder apparatuses known in the art are bulky, making traveling difficult. Further, current luggage tag apparatuses known in the art do not contain a place to hold one's beverage.

Therefore, it would be desirable to provide a system and method that cure the shortfalls of the previous approaches identified above.

SUMMARY

A collapsible cup holder is disclosed in accordance with one or more embodiments of the present disclosure. In one embodiment the collapsible cup holder apparatus includes one or more collapsible panels. In another embodiment, the collapsible cup holder apparatus includes one or more plates. The one or more plates are coupled to the one or more collapsible panels. In another embodiment the container apparatus includes one or more attaching mechanisms. The one or more attaching mechanisms are coupled to at least one of the one or more collapsible panels or the one or more plates.

A collapsible cup holder is disclosed in accordance with one or more embodiments of the present disclosure. In one embodiment, the collapsible cup holder apparatus includes one or more collapsible panels. In another embodiment, the collapsible cup holder apparatus includes one or more plates. The one or more plates are coupled to the one or more collapsible panels. In another embodiment, the collapsible cup holder apparatus includes one or more fasteners. The one or more fasteners are operably coupled to the one or more plates. The one or more fasteners are configured to hold the one or more collapsible panels in a collapsed positioned.

A collapsible cup holder is disclosed in accordance with one or more embodiments of the present disclosure. In one embodiment, the collapsible cup holder apparatus includes one or more collapsible panels. In another embodiment, the collapsible cup holder apparatus includes one or more plates. The one or more plates are coupled to the one or more collapsible panels. In another embodiment, the collapsible cup holder apparatus includes one or more label members. The one or more label members are configured to hold an insertable label.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Reference will now be made in detail to the subject matter disclosed, which is illustrated in the accompanying drawings.

Referring generally to FIGS. 1-10, a collapsible cup holder apparatus is described, in accordance with one or more embodiments of the present disclosure.

Embodiments of the present disclosure are directed to a collapsible cup holder apparatus including a label holding member configured to hold an insertable label.

Figure 1:
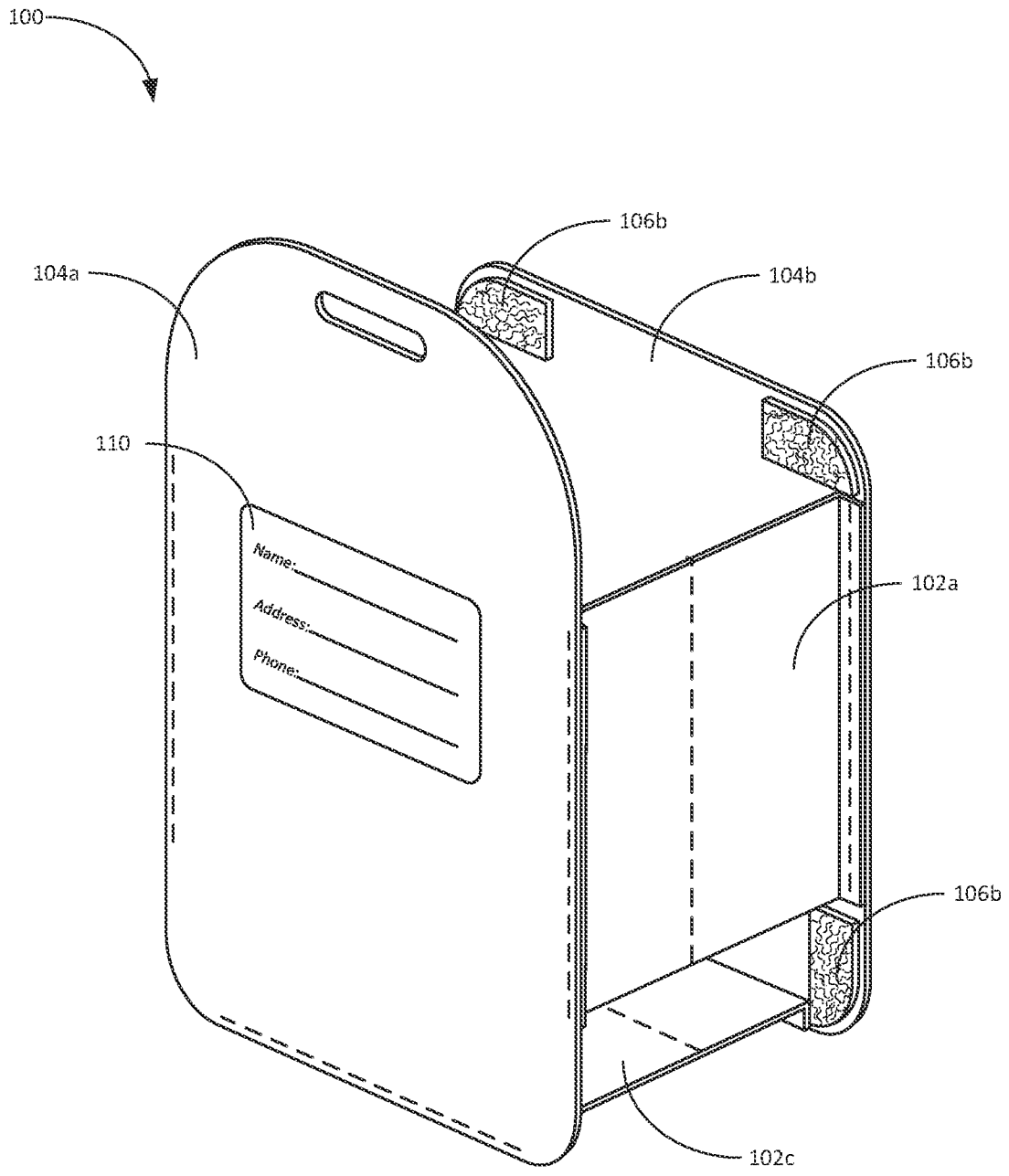
FIG. 1 illustrates a perspective view of a collapsible cup holder apparatus, in accordance with one or more embodiments of the present disclosure.
Figure 2:
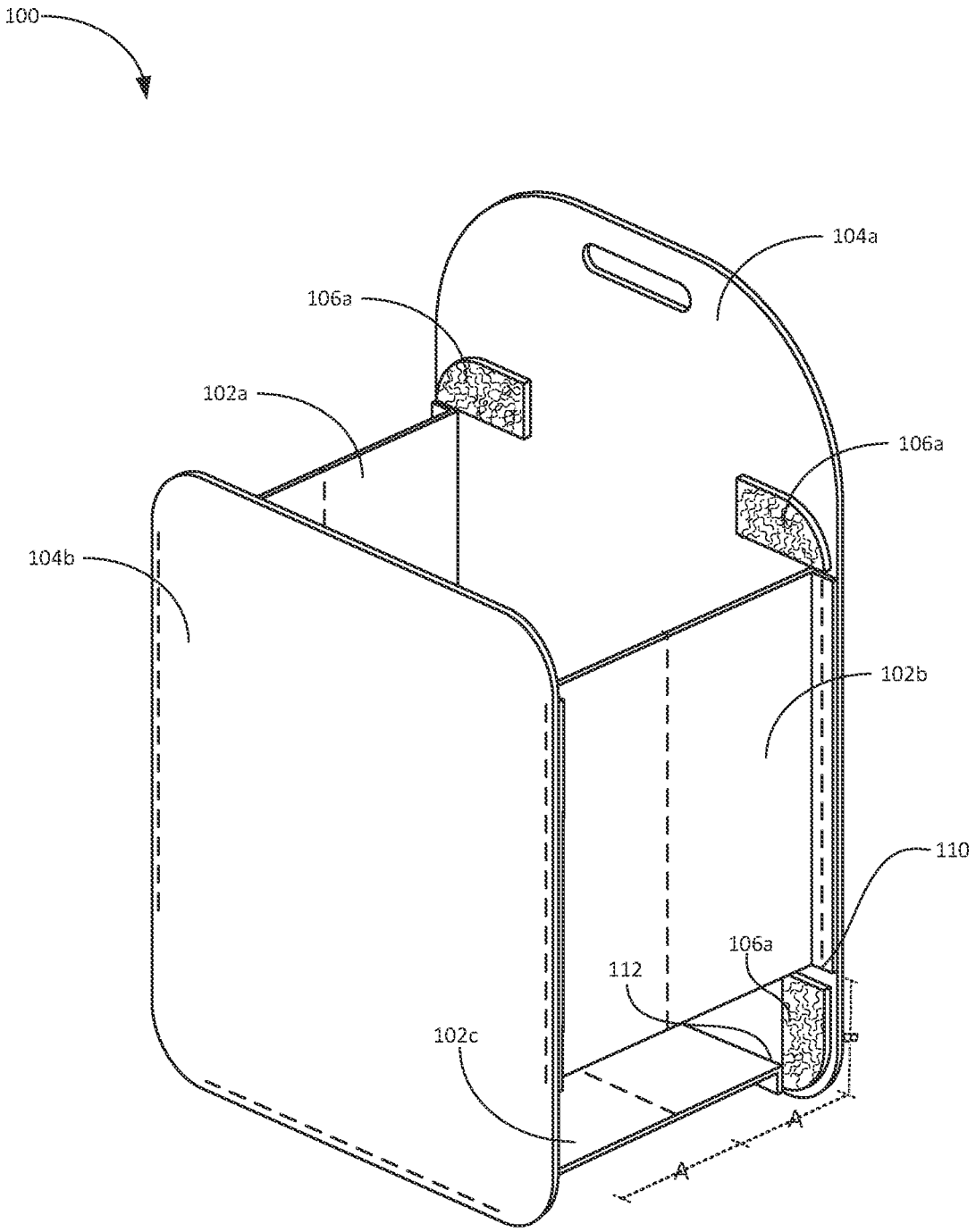
FIG. 2 illustrates a perspective back view of a collapsible cup holder apparatus, in accordance with one or more embodiments of the present disclosure.
Figure 3:
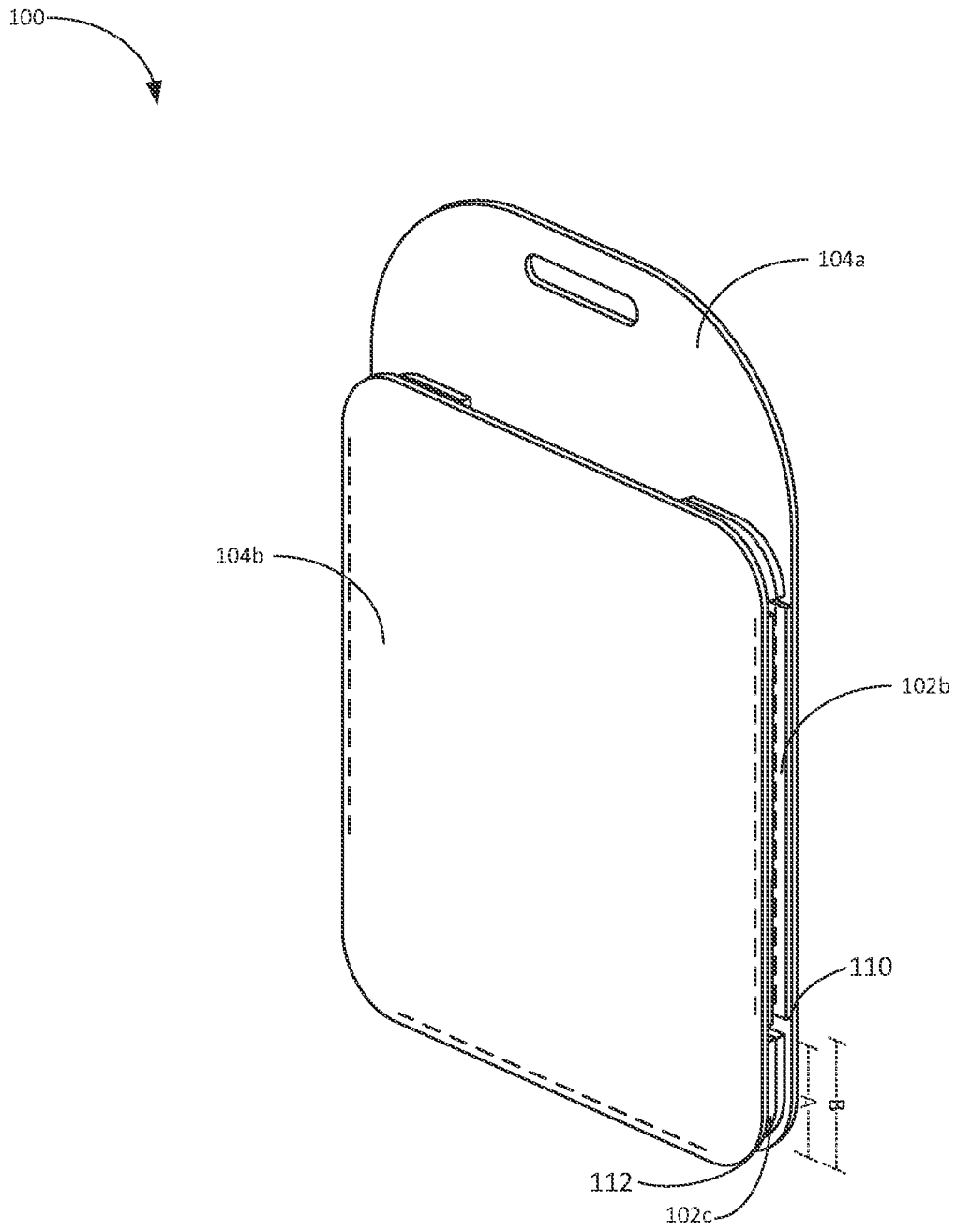
FIG. 3 illustrates a perspective view of a collapsible cup holder apparatus in a collapsed position, in accordance with one or more embodiments of the present disclosure.

FIGS. 1 through 3 generally illustrate perspective views of a collapsible cup holder apparatus 100, in accordance with one or more embodiments of the present disclosure.

The collapsible cup holder apparatus 100 may include one or more collapsible panels 102 (e.g., side panels 102*a* and 102*b*, and bottom panel 102*c*), one or more plates 104 (e.g., a front plate 104*a* and a back plate 104*b*), one or more fastening members 106, and one or more attaching mechanisms 108.

The one or more plates 104 may be coupled to the one or more collapsible panels 102 along their respective edges. The one or more plates 104 may be coupled to the one or collapsible panels 102 using any fabrication process known in the art. For example, the one or more plates 104 may be coupled to the one or more collapsible panels 102 using adhesive bonding including, but not limited to, glue, epoxies, bonding agents, or the like. For instance, the one or more plates 104 may be coupled to the one or more collapsible panels 102 by curing a bonding agent with heat. By way of another example, the one or more plates 104 may be coupled to the one or more collapsible panels 102 using a sewing machine. For instance, as shown in FIGS. 1-10, the one or more collapsible panels 102 and one or more plates 104 may be stitched together via thread of a sewing machine. As shown in FIGS. 2 and 3, a bottom edge of the side collapsible panels 102*a* and/or 102*b* may be aligned at an intermediary location 110 of the front plate 104*a* and/or the back plate 104*b* (e.g., a position which does not align with the bottom of the of the front plate 104*a* and/or the back plate 104*b*). For example, in one embodiment, the bottom collapsible panel 102*c* may have a depth of 2 A. The intermediary position 110 of bottom edge of the side collapsible panels 102*a* and/or 102*b* may be separated by a distance B from a joining point 112 between the bottom collapsible panel 102*c* and the front plate 104*a* and/or the back plate 104*b*. As shown in FIG. 3, distance B may be greater than half of the depth, A, of the bottom collapsible panel 102*c*. In such a configuration, when the collapsible side/bottom panels 102 are collapsed inwardly, as in FIG. 3, the folded panels will not overlap with one another such that the collapsible cup holder apparatus 100 may be collapsed to provide as thin of a profile as possible.

The cup holder apparatus 100 may further include one or more fastening members 106 operably coupled to the one or more plates 104. The one or more fastening members 106 may be configured to hold the one or more collapsible panels 102 in a collapsed position as shown in FIG. 3. For example, the one or more fastening members 106 may include, but not limited to, a hook and loop, a magnet, a snap button, or the like. For instance, as shown in FIG. 3, a front plate 104*a* may include a hook-type fastener 106*a* and a rear plate 104*b* may include a loop-type fastener 106*b* whereby, when the hook and loop are affixed to one another, the apparatus 100 is secured in a collapsed position. By way of another example, the one or more fastening members 106 may include, but not limited to, one or more snap buttons. For instance, a first part of the one or more snap buttons may be coupled to the front plate 104*a* and a second part of the one or more snap buttons may be coupled to the back plate 104*b* such that when the one or more snap buttons are in a secured position that apparatus 100 is in a collapsed position.

The location of one or more fastening members 106 shown in FIGS. 1 through 3 is provided merely for illustrative purposes and shall not be construed as limiting the scope of the present disclosure. Although only four fastening members 106 are shown in FIGS. 1 through 3 at both the top and bottom of the plates 104, it is noted herein that the apparatus 100 may include any number of fastening members 106 such that the collapsible panels 102 may be secured in a collapsed position.

Figure 4:
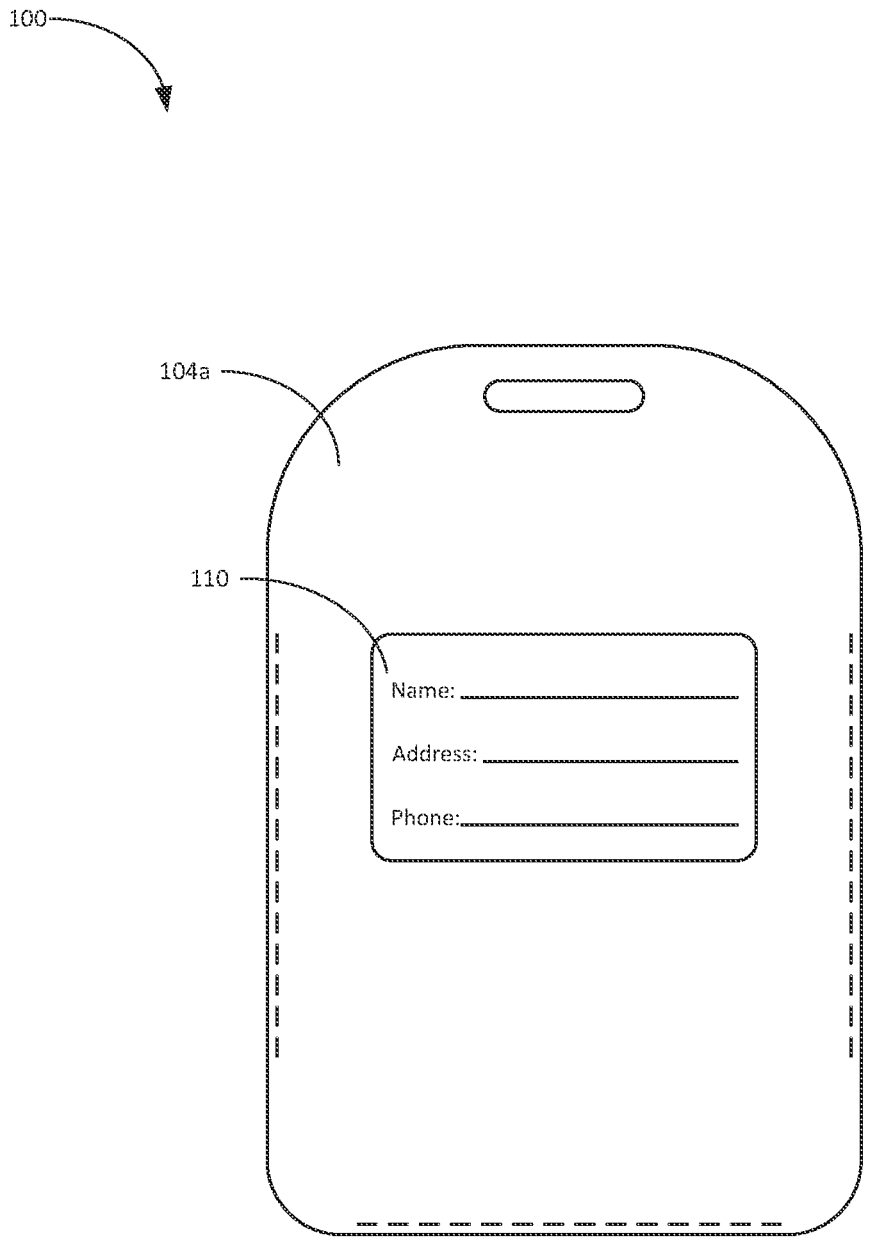
FIG. 4 illustrates a front view of a collapsible cup holder apparatus, in accordance with one or more embodiments of the present disclosure.
Figure 5:
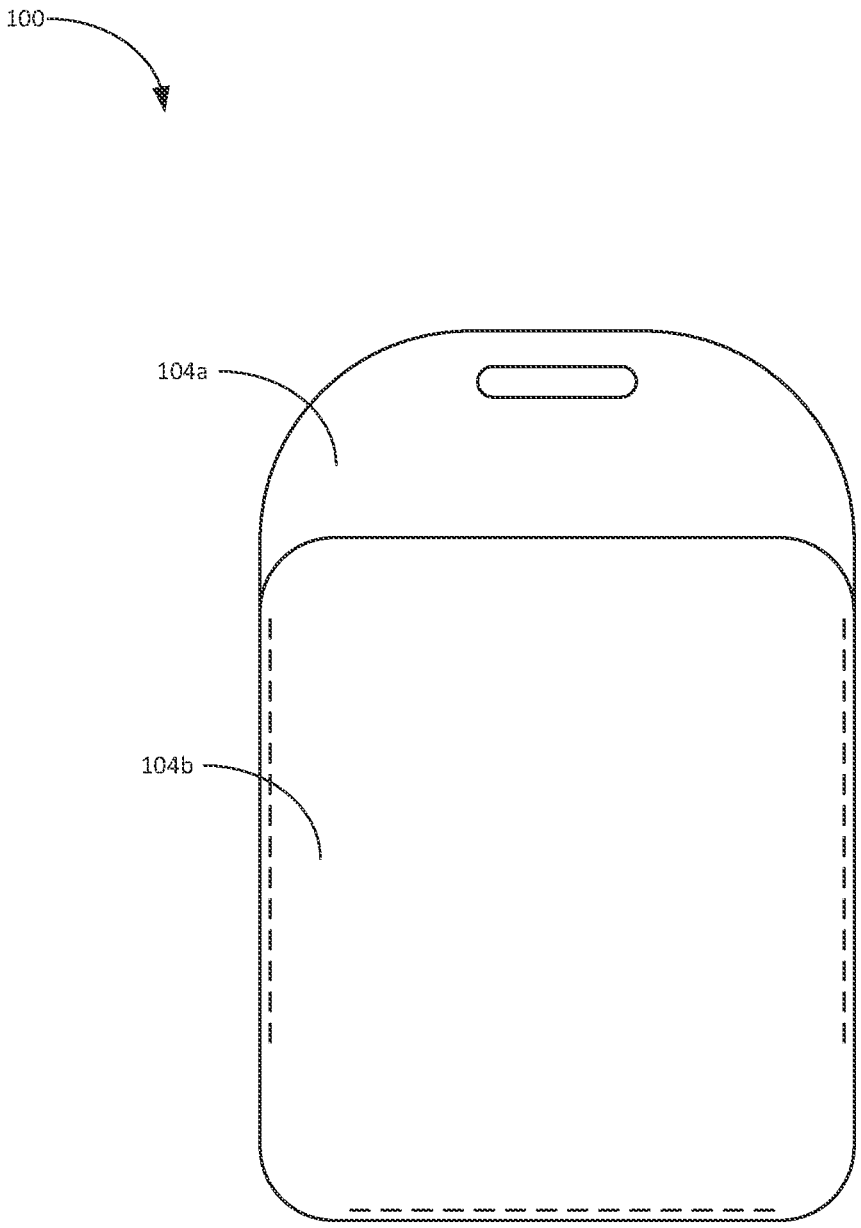
FIG. 5 illustrates a back view of a collapsible cup holder apparatus, in accordance with one or more embodiments of the present disclosure.

FIGS. 4 through 5 illustrate a front and a back view of the collapsible cup holder apparatus 100, in accordance with one or more embodiments of the present disclosure.

The one or more plates 104 may include a label holding member 110. The label holding member 110 may be configured to hold an insertable label. For example, the label holding member 110 may be configured to hold an insertable label which includes a user's personal identification information. It is noted that insertable label shown in FIG. 4 is provided merely for illustrative purposes and should not be interpreted to limit the scope of the present disclosure. The insertable label may include any combination of a user's personal identification information including, but not limited to, name, address, phone number, e-mail address, or the like. For example, as shown in FIG. 4, the insertable label may include a user's name, address, and phone number.

The label holding member 110 may include a protective member configured to protect the insertable label from water, dirt, or the like. The protective member may further be configured to protect the personal identification information contained on the insertable label such that the protective member acts as a privacy measure. For example, the protective member may be a privacy measure used to protect a user's identity while traveling. The protective member may be any material known in art including, but not limited to, a plastic (e.g., polyester, polyvinylchloride, or the like). The protective member may be transparent such that the information contained on the label is visible. The protective member may be non-transparent such that the information contained on the label is not visible.

The label holding member 110 may be any label holding member known in the art. For example, the label holding member 110 may be a pocket affixed the outer surface of the one or more plates 104. By way of another example, the label holding member 110 may be a pocket affixed to the inner surface of the one or more plates 104 and the one or more plates 104 may include a cut-out proximate to the pocket such that the contents of the insertable label are visible. It is noted herein that the apparatus 100 may not include the label holding member 110. For example, the one or more plates 104 may be coupled to a label via any fastening mechanism known in the art, such as but not limited to, glued, stitched, buttoned, or the like.

The location of the label holding member 110 and/or the location of the insertable label may vary. For example, the label holding member 110 may be placed on the front one or more plates 104. By way of another example, the label holding member 110 may be placed on the rear one or more plates 104. The location depicted in FIG. 4 is provided merely for illustrative purposes and shall not be construed as limiting the scope of the present disclosure.

Figure 6:
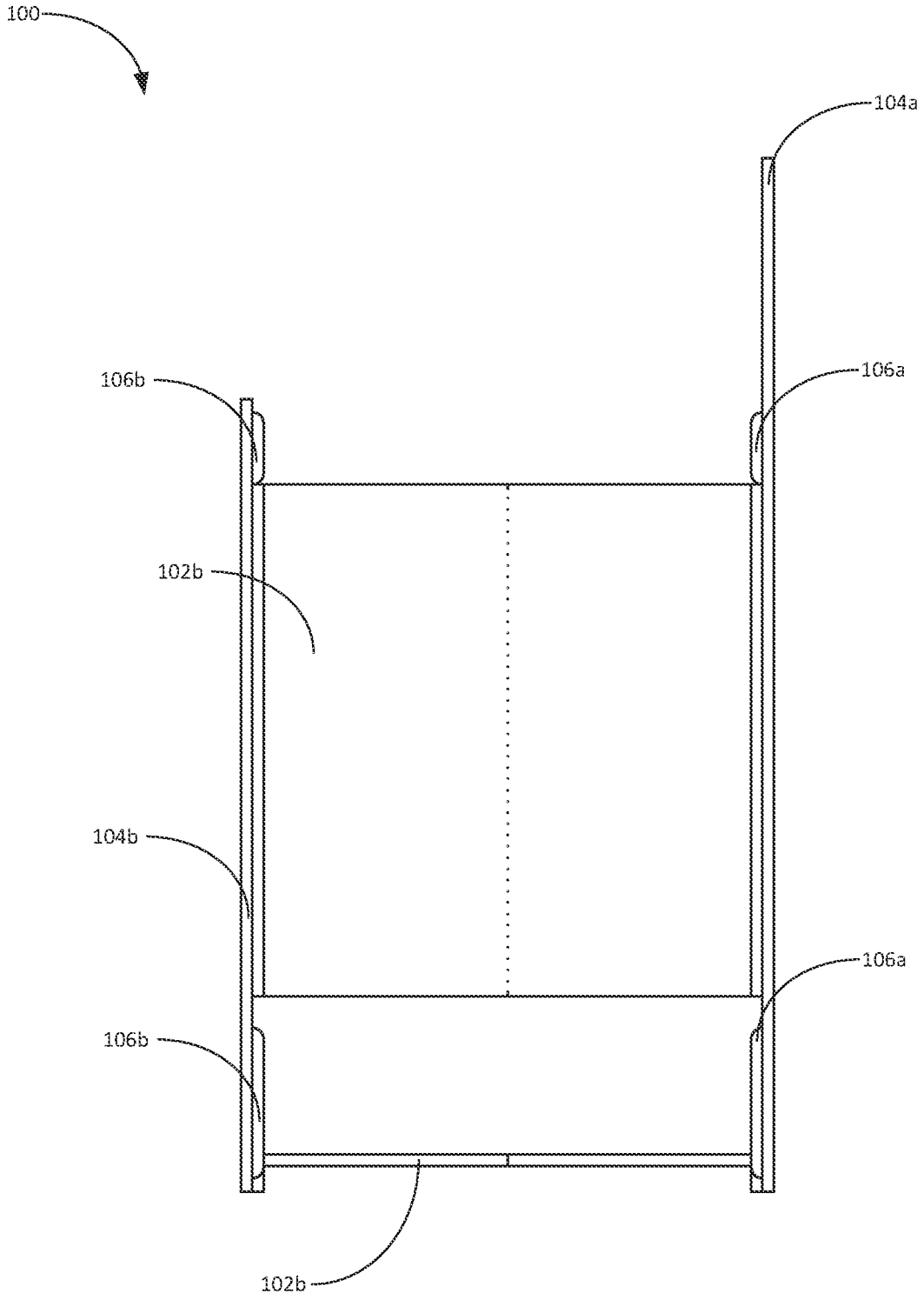
FIG. 6 illustrates a side view of a collapsible cup holder apparatus, in accordance with one or more embodiments of the present disclosure.

FIG. 6 illustrates a side view of the collapsible cup holder apparatus 100, in accordance with one or more embodiments of the present disclosure.

The one or more collapsible panels 102 may include a hinged panel. The hinged panel of the one or more collapsible panels 102 may include a living hinge mechanism, a bi-fold hinge mechanism, an accordion hinge mechanism, or the like. For example, the hinged panel of the one or more collapsible panels 102 may be the living hinge mechanism, as shown in FIG. 6, such that a thin section of material acts as a connection between two larger sections. For instance, the living hinge mechanism may allow the one or more collapsible panels 102 to rotate 180 degrees about an axis.

By way of another example, the hinged panel of the one or more collapsible panels 102 may be a bi-fold hinge mechanism, such that the bi-fold hinge mechanism allow the one or more collapsible panels 102 to fold twice.

Figure 7:
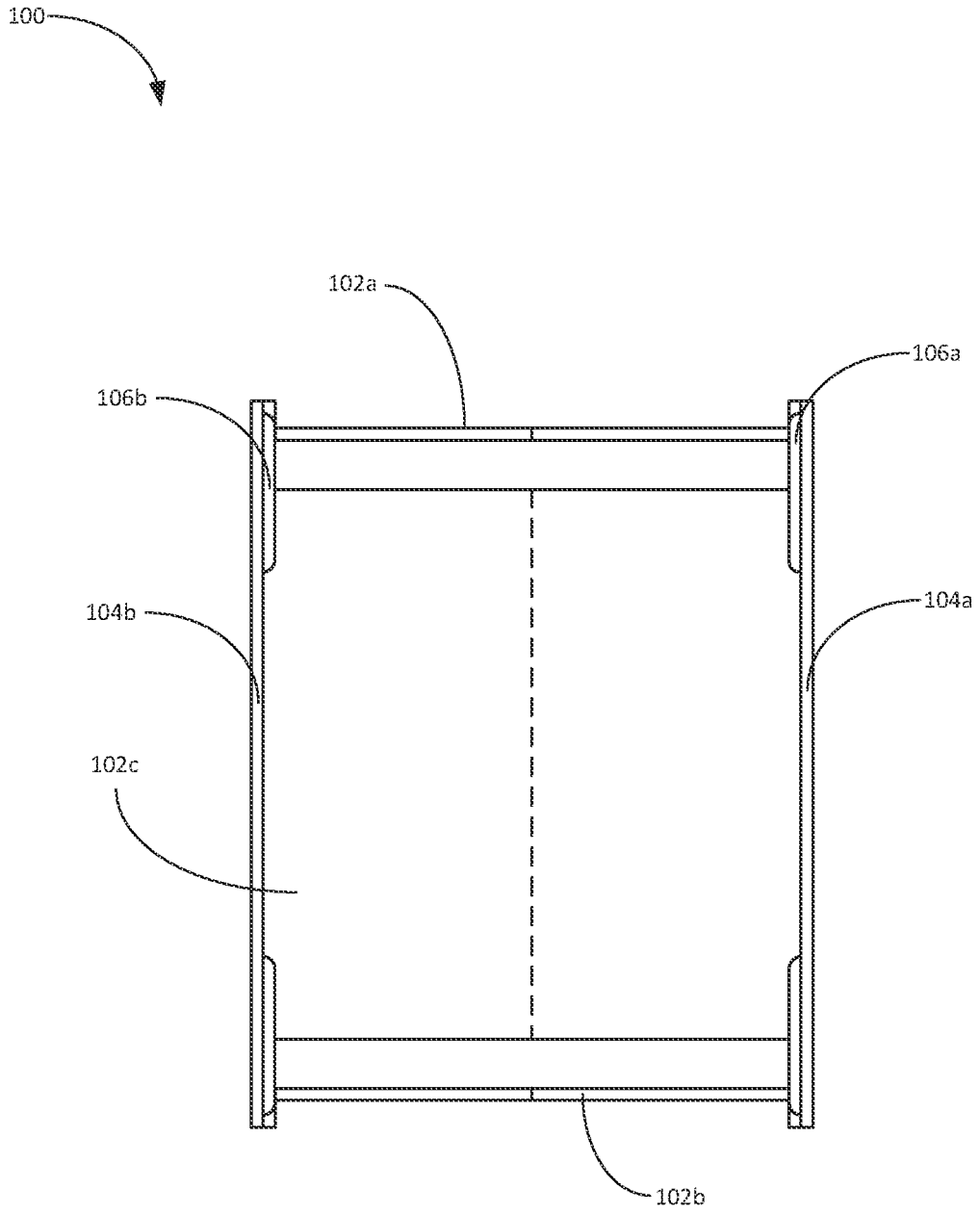
FIG. 7 illustrates a top view of a collapsible cup holder apparatus, in accordance with one or more embodiments of the present disclosure.
Figure 8:
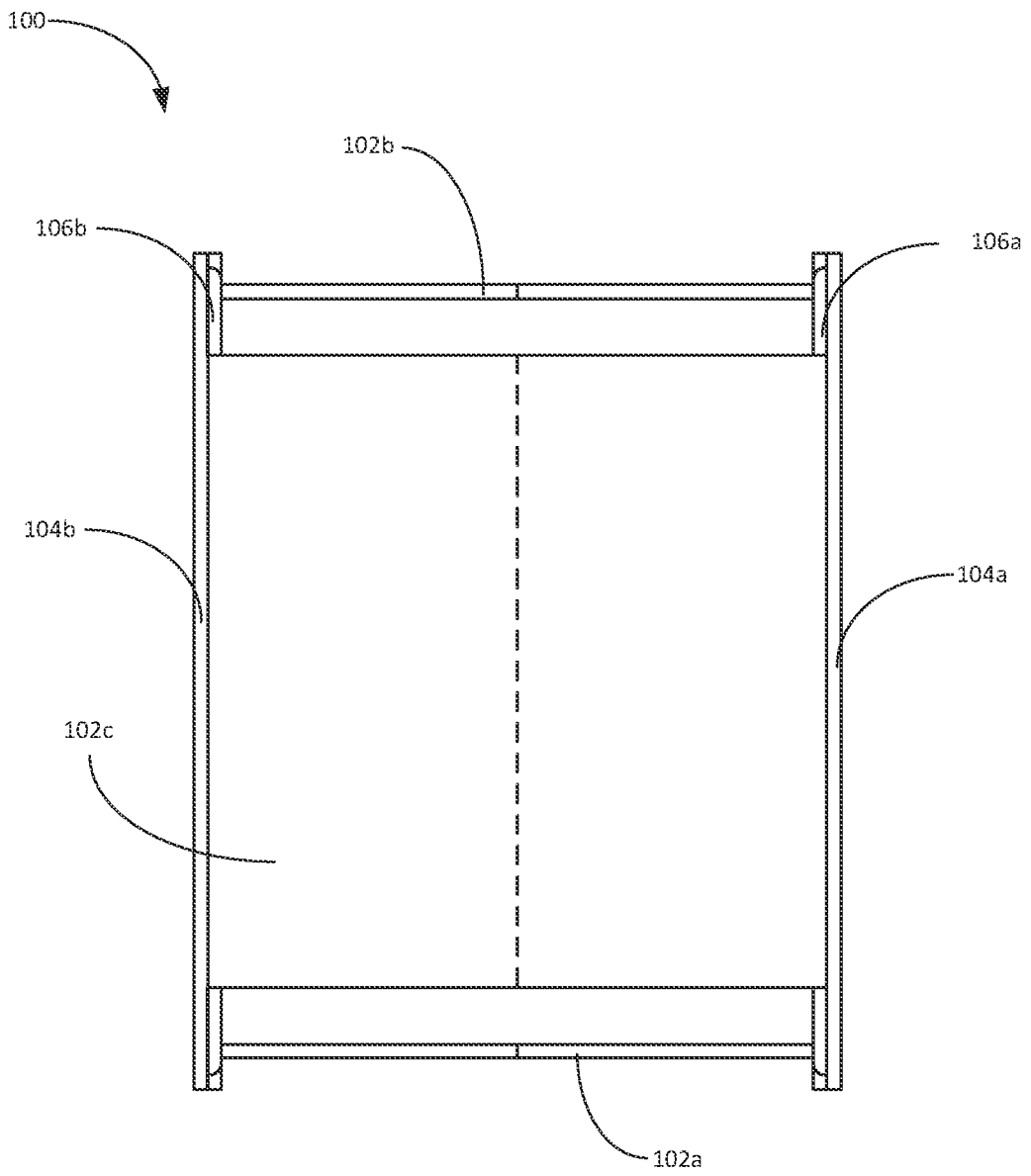
FIG. 8 illustrates a bottom view of a collapsible cup holder apparatus, in accordance with one or more embodiments of the present disclosure.

FIGS. 7 and 8 illustrate a top view and a bottom view of the collapsible cup holder apparatus 100, in accordance with one or more embodiments of the present disclosure.

Figure 9:
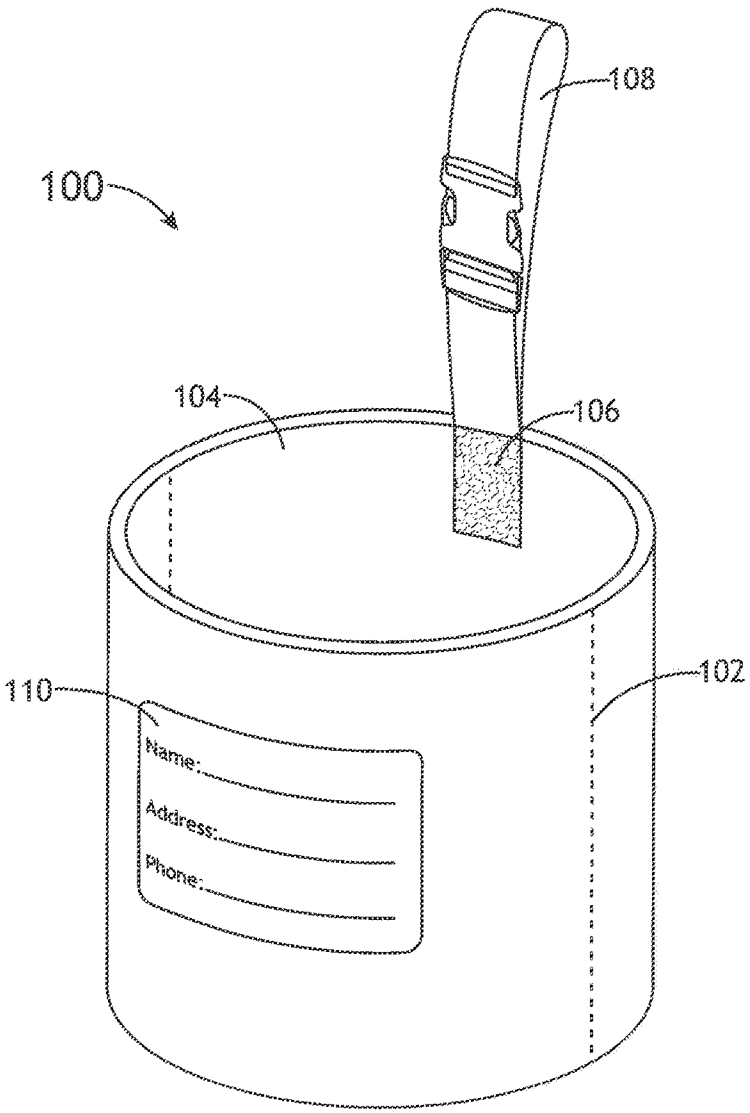
FIG. 9 illustrates an orthogonal view of a collapsible cup holder apparatus in an non-collapsed and collapsed position, in accordance with one or more embodiments of the present disclosure.
Figure 9:
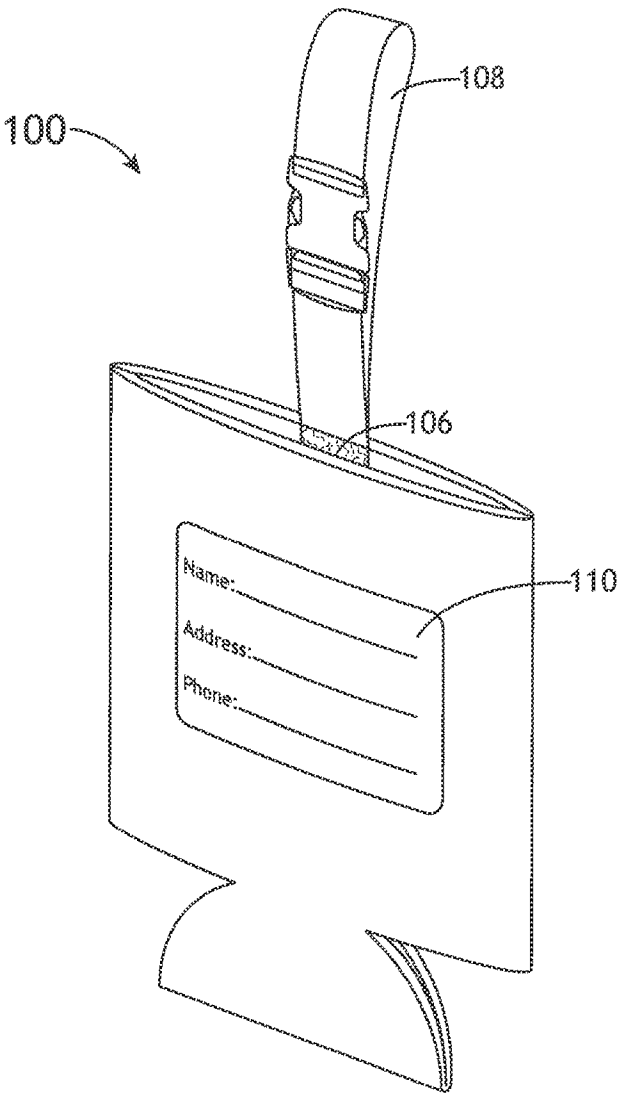

FIG. 9 illustrates an orthogonal view of the collapsible cup holder apparatus 100 in an non-collapsed and collapsed position, in accordance with one or more embodiments of the present disclosure; and The one or more plates 104 and the one or more collapsible panels 102 may be arranged in a continuous configuration. For example, the one or more plates 104 and the one or more collapsible panels 102 may be arranged in a cup holder sleeve (e.g., koozie) configuration.

Figure 10:
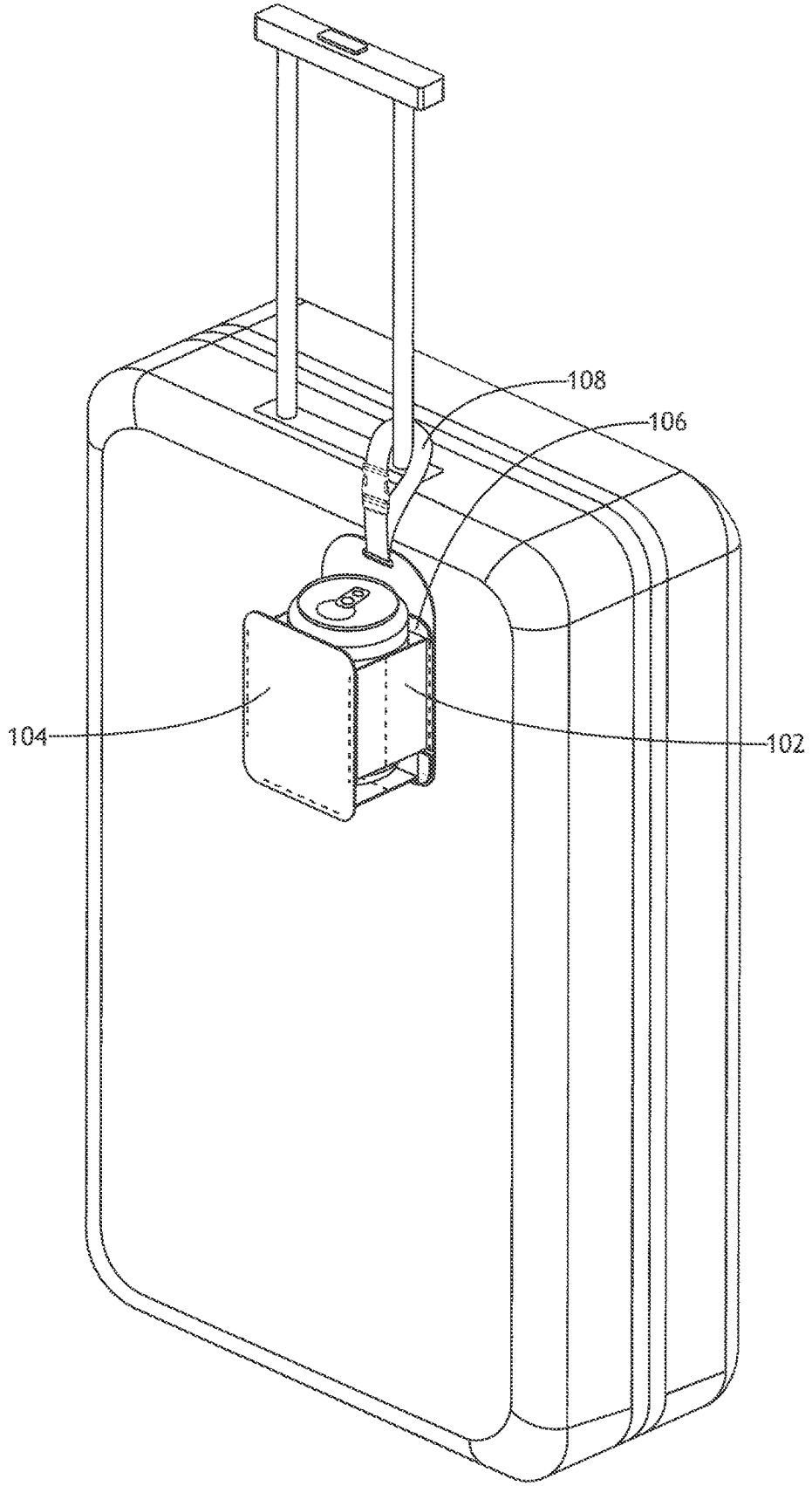
FIG. 10 illustrates an implementation of a collapsible cup holder apparatus, in accordance with one or more embodiments of the present disclosure.
Figure 11:
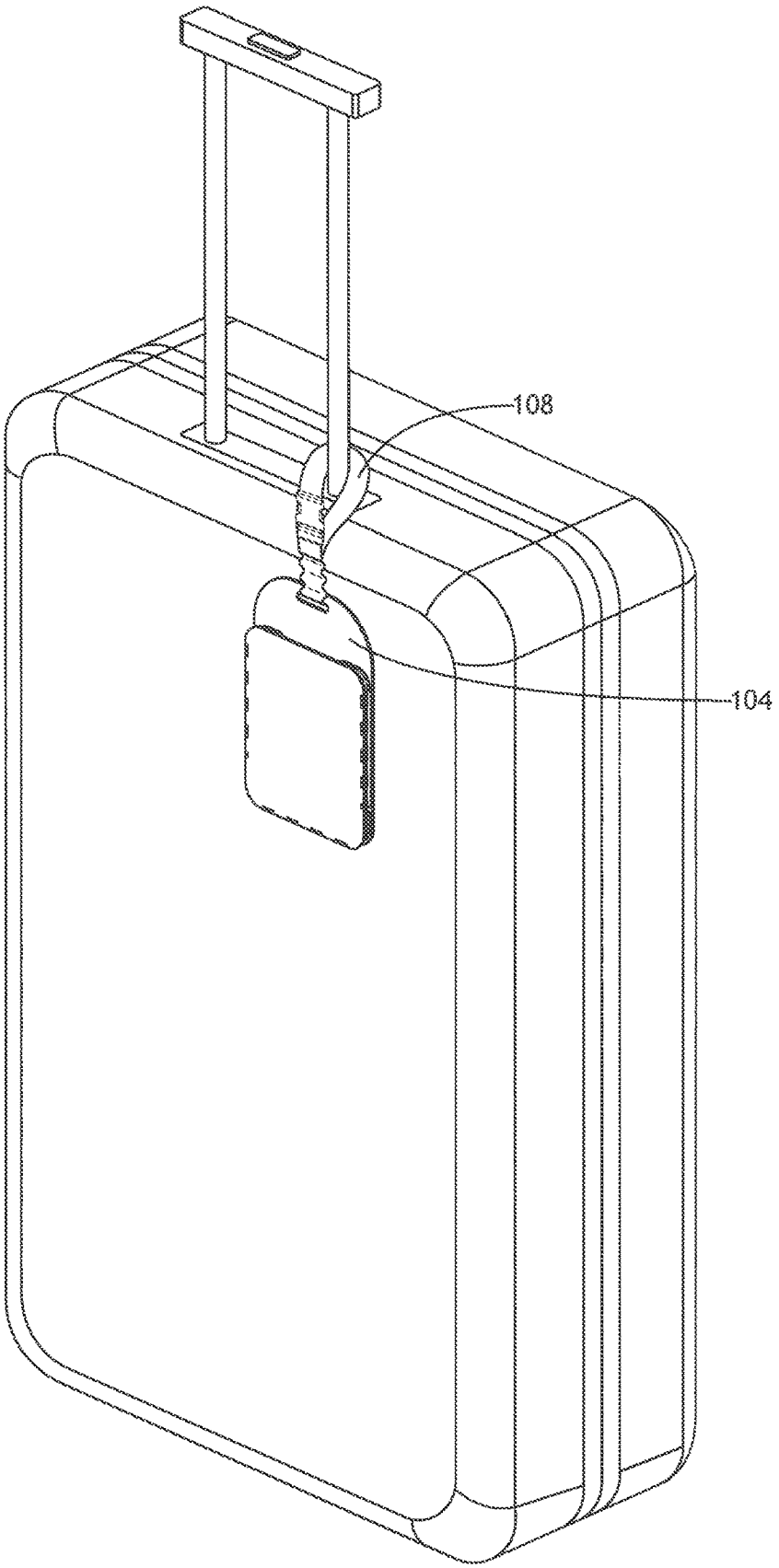
FIG. 11 illustrates an implementation of a collapsible cup holder apparatus, in accordance with one or more embodiments of the present disclosure.
Figure 12:
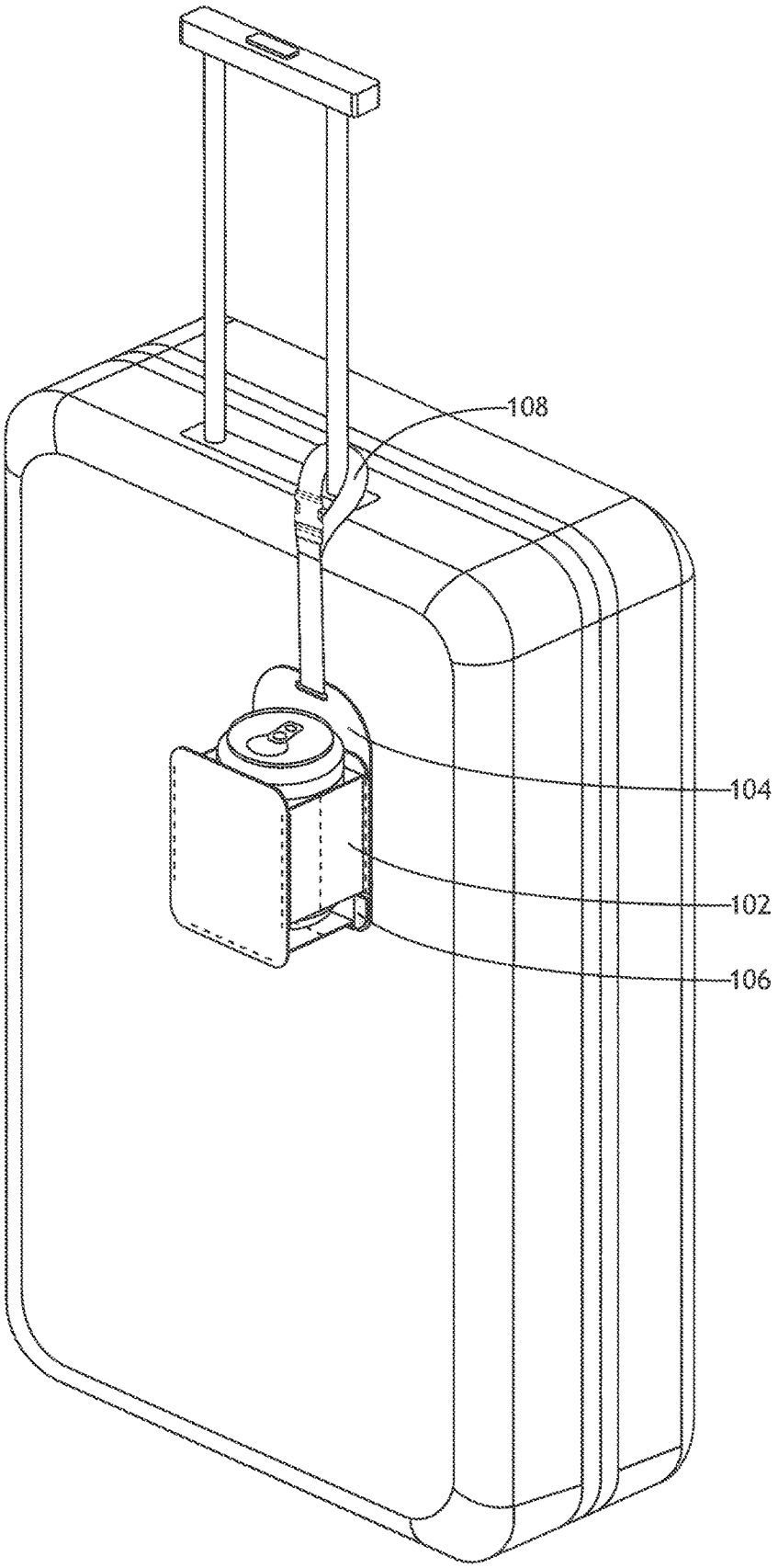
FIG. 12 illustrates an implementation of a collapsible cup holder apparatus, in accordance with one or more embodiments of the present disclosure.

FIGS. 10 through 12 illustrate implementations of the collapsible cup holder apparatus 100, in accordance with one or more embodiments of the present disclosure.

The one or more attaching mechanisms 108 may be configured to attach the cup holder apparatus 100 with a handle of a bag, suitcase, backpack, purse, briefcase, or the like. The attaching mechanism 108 may include any mechanism known in the art. For example, the attaching mechanism 108 may include, but not limited to, a strap, a clip, a clamp, or the like. For instance, as shown in FIG. 10, the attaching mechanism 108 may include a strap with a side release buckle such that a user may attach the cup holder apparatus 100 to a suitcase handle and place a beverage inside the apparatus 100. By way of another example, as shown by FIGS. 11 and 12, the attaching mechanism 108 may include an elastic strap such that the attaching member 108 may stretch a distance from the handle and the cup holder apparatus 108 may be positioned in an upright position. FIG. 11 illustrates the elastic strap in a relaxed position (e.g., not stretched), while FIG. 12 illustrates the elastic strap in a stretched position. By way of an additional example, the attaching mechanism 108 may include a retractable strap such that the retractable strap includes spring loaded coils configured to allow the attaching mechanism 108 to stretch a distance from the handle.

The one or more attaching mechanisms 108 may be coupled to the one or more plates 104 via any mechanism known in the art. For example, as shown in FIGS. 1-8, at least one of the one or more plates 104 may have a slit configured to allow the attaching mechanism 108 to slide into the slit. By way of another example, at least one of the one or more plates 108 may couple to the attaching mechanism 108 using a sewing machine (as discussed above) The mechanism shown in FIGS. 1 through 8 is provided merely for illustrative purposes and shall not be interpreted to limit the scope of the present disclosure.

It is noted herein that the cup holder apparatus 100 may be configured for any type of cup. For example, the cup holder apparatus 100 may be configured to hold a can of soda or beer. By way of another example, the cup holder apparatus 100 may be configured to hold a bottle of soda. By way of a further example, the cup holder apparatus 100 may be configured to hold a cup of coffee or tea. By way of an additional example, the cup holder apparatus 100 may be configured to hold a juice box or juice pouch. By way a further example, the cup holder apparatus 100 may be configured to hold a water bottle.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken as limiting.

Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary.

The previous description is presented to enable one of ordinary skill in the art to make and use the invention as provided in the context of a particular application and its requirements. As used herein, directional terms such as "top," "bottom," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

All of the methods described herein may include storing results of one or more steps of the method embodiments in memory. The results may include any of the results described herein and may be stored in any manner known in the art. The memory may include any memory described herein or any other suitable storage medium known in the art. After the results have been stored, the results can be accessed in the memory and used by any of the method or system embodiments described herein, formatted for display to a user, used by another software module, method, or system, and the like. Furthermore, the results may be stored "permanently," "semi-permanently," temporarily," or for some period of time. For example, the memory may be random access memory (RAM), and the results may not necessarily persist indefinitely in the memory.

It is further contemplated that each of the embodiments of the method described above may include any other step(s) of any other method(s) described herein. In addition, each of the embodiments of the method described above may be performed by any of the systems described herein.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A collapsible cup holder apparatus, comprising:

a first inwardly collapsible side panel;

a second inwardly collapsible side panel;

an inwardly collapsible bottom panel;

a first plate having a first height;

a second plate having a second height less than the first height;

one or more label holding members, located on an outer facing surface of at least one of the first plate or the second plate, configured to hold an insertable label;

one or more fastening members coupled to at least one of the first plate or the second plate, the one or more fastening members configured to hold the collapsible cup holder apparatus in a collapsed position; and at least one attaching mechanism coupled to the first plate at a position above the uppermost extent of the second plate;

wherein the first inwardly collapsible side panel, the second inwardly collapsible side panel and the inwardly collapsible bottom panel are separated from one another.

2. The apparatus of claim 1, wherein at least one of the first collapsible side panel or the second collapsible side panel or the collapsible bottom panel includes:

a hinged panel.

3. The apparatus of claim 2, wherein the hinged panel includes:

a living hinge mechanism, a bi-fold hinge mechanism, or an accordion hinge mechanism.

4. The apparatus of claim 1, further comprising:

one or more fastening members operably coupled to at least one of the first plate or the second plate, wherein the one or more fastening members are configured to hold the collapsible container holding apparatus in a collapsed position.

5. The apparatus of claim 1, wherein the one or more label holding members includes:

one or more label holding members configured to hold at least one of an identification tag or a name tag.

6. The apparatus of claim 1, wherein the at least one attaching mechanism includes:

at least one of a strap, a clip, or a clamp.

7. The apparatus of claim 1, wherein the one or more fastening members include:

at least one of a hook and loop, a magnet, or a snap button.

* * * * *